US006339760B1

(12) United States Patent
Koda et al.

(10) Patent No.: US 6,339,760 B1
(45) Date of Patent: Jan. 15, 2002

(54) METHOD AND SYSTEM FOR SYNCHRONIZATION OF DECODED AUDIO AND VIDEO BY ADDING DUMMY DATA TO COMPRESSED AUDIO DATA

(75) Inventors: Eriko Koda, Kawasaki; Kei Kudou, Hadano, both of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/299,572

(22) Filed: Apr. 27, 1999

(30) Foreign Application Priority Data

Apr. 28, 1998 (JP) ..... 10-118130

(51) Int. Cl.[7] ..... G10L 21/04
(52) U.S. Cl. ..... 704/278; 704/270
(58) Field of Search ..... 704/270, 278

(56) References Cited

U.S. PATENT DOCUMENTS 5,068,752 A * 11/1991 Tanaka et al. ..... 360/32
5,832,085 A * 11/1998 Inoue et al. ..... 386/124
5,848,154 A * 12/1998 Nishio et al. ..... 705/51
5,899,577 A * 5/1999 Fujisaki et al. ..... 386/68

FOREIGN PATENT DOCUMENTS

JP A-9-37204 2/1997

* cited by examiner

*Primary Examiner*—Tālivaldis Ivars Smits
(74) *Attorney, Agent, or Firm*—Antonelli, Terry, Stout & Kraus, LLP

(57) ABSTRACT

A method for editing audio data includes the steps of creating a header portion containing at least information for indicating a start of an audio unit to be decoded and having composite elements whose values are equal to those of the audio data to which dummy data is to be added, and creating the audio data composed of the dummy data to be ignored during a decoding time. The system for editing audio data is also provided for executing the editing method.

9 Claims, 5 Drawing Sheets

METHOD AND SYSTEM FOR SYNCHRONIZATION OF DECODED AUDIO AND VIDEO BY ADDING DUMMY DATA TO COMPRESSED AUDIO DATA

CROSS-REFERENCE TO RELATED APPLICATION

The present application relates to subject matter described in application Ser. No. 09/205,620 filed on Dec. 4, 1998 entitled "A METHOD AND APPARATUS FOR CONTROLLING A BIT RATE OF PICTURE DATA, AND A STORAGE MEDIUM WHICH STORES A PROGRAM FOR CONTROLLING THE BIT RATE", the disclosure of which is hereby incorporated by reference.

BACKGROUND OF THE INVENTION

The present invention relates to a method and an apparatus for editing audio data.

In recent days, video data may be treated by a home computer because a lower price of a secondary storage device and a lower compressing rate of video data caused by the MPEG (Moving Picture Experts Group) that is the de facto international standard of the technique of compressing video data.

The MPEG is the international standard about compression of a moving picture established by the ISO (International Organization for Standardization). At first, the MPEG-1 is made public and then the MPEG-2 is established. The MPEG-2 is the compressing standard for broadcasting. The MPEG-1 is the technique of transferring a picture at a rate of about 1–5 Mbps and regenerating the transferred picture at a resolution of about 352×240 pixels and at a rate of about 30 frames per second (for the NTSC) or about 24 frames (for the PAL). It is widely known that the picture quality of the decoded MPEG-1 data corresponds to the quality of the VHS type video cassette. On the contrary, the MPEG-2 is the technique of regenerating a picture consisting of about 720×490 pixels at a transfer rate of 4.0 to 8.0 Mbps. Compared with the quality of the MPEG-1, it is understood that the picture quality of the MPEG-2 corresponds to the quality of the LD (Laser Disk).

Normally, the MPEG data is generated by encoding (compressing) the analog moving picture inputted by a camera or a capture board in the MPEG format. The captured MPEG data may be regenerated by the personal computer in which the MPEG decoder (in the form of software or hardware) is installed.

The MPEG data is formed of an MPEG system stream composed by multiplexing an MPEG video stream that is the compressed video data and an MPEG audio stream that is the compressed audio data. The data normally called the MPEG data is the MPEG system stream. Only the MPEG video stream or the MPEG audio stream may be regenerated by a software implemented decoder or the like.

The MPEG normally has a picture rate (frames per one second) of 30, in which case the regenerating time length of the video data consisting of 900 frames is 30 sections. Hence, in the case of 30 frames per second, the regenerating time length of one frame is about 33 ms. On the other hand, the MPEG audio data is divided into three layers, that is, the layer 1, the layer 2 and the layer 3, whose sampling frequencies are 32 KHz, 44.1 KHz and 48 KHz, respectively. Further, the AAU (Audio Access Unit) that is a compression unit of the MPEG audio data has 384 samples for the layer 1 or 1152 samples for the layer 2 and the layer 3.

Like the normal uncompressed data, the MPEG data may be used as is or subject to some treatments such as partial deletion and effective paste of data pieces. If the video data piece is pasted with the audio data piece, it is necessary to synchronize both of the data pieces with each other. In practice, however, both of the data pieces often have the different lengths. It disadvantageously brings about a lag between the video data piece and the audio data piece.

This disadvantage will be described below with reference to FIG. 2. The BGM (audio data) B of 20 seconds is pasted with the frame of the video data A. The pasted data is then pasted with the video data C of 900 frames (30 seconds) and the audio data D of 30 seconds. As is clearly shown, some lag takes place between the start edges of the video data C and the audio data D. Further, the video data C and the audio data D are then pasted with the video data E and the audio data F each having the same regenerating time length as the video data C and the audio data D. In this case, the lag of synchronization is continued as well.

Hence, the technique of overcoming this lag of synchronization is described in JP-A-09-37204. This technique is arranged to separate the compressed data into the compressed moving picture data and the compressed audio data and compare both of the data with each other at regenerating time. If the audio data has a shorter regenerating time than the moving picture data, the prepared silent PCM data is compressed for generating the silent compressed audio data extending for a necessary length of time and is pasted with the audio data. Then, the moving picture data and the audio data are synthesized with each other.

However, the foregoing technique requires compressing the silent PCM data. Hence, if the silent length to be added extends for a long time, it disadvantageously takes a considerable time to compress the PCM data.

Moreover, while the MPEG system stream is created by an encoder, the moving picture data is continuously inputted into the encoder. However, the sound may be discontinued or the audio data may be also paused by a mute function. In such a case, the encoder operates to compress the silent audio data for creating the moving picture data. Like the above, if the silent time continues for a considerably long time, disadvantageously, it also takes a long time to compress the data.

SUMMARY OF THE INVENTION

It is an object of the present invention to create dummy audio data that does not need the compressing process.

It is a further object of the present invention to adjust the regenerating time length of the audio data with the dummy audio data that does not need the compression and to solve a lag of synchronization between the video data and the audio data.

According to the invention, an editing method and an editing system are disclosed for creating dummy audio data without compression consisting of a header portion containing at least information (e.g., syncword) for indicating a start of an audio decode unit (e.g., AAU) and dummy data that is to be ignored in decoding. The retrieval of the next header portion is started without decoding this dummy audio data. As a result, the silent interval is continued for a length of time when the next data is being retrieved.

According to an aspect of the invention, when the video data is pasted with the audio data, if the audio data has a shorter regenerating time length than the video data, the audio data is composed by synthesizing a header portion that corresponds to the header information extracted from the audio data with the dummy data that is to be ignored by a regenerating device side. The composed audio data corresponding to a shortage time of the audio data in the MPEG audio stream is added to the MPEG audio stream.

In the process of creating the moving picture and audio data as capturing the video data and the audio data, if the audio data is silent, the process is executed to create dummy audio data consisting of the header of the compressed audio data and the dummy data and to synthesize the dummy audio data with the video data for creating the moving picture and audio data.

The present invention offers numerous effects, the particularly great effect of which is no necessary compression of the audio data when creating the dummy audio data. When the audio data is pasted with the video data, if the audio data is shorter than the video data, the regenerating time length of the audio data can be adjusted in a short time. Further, the process of creating the moving picture and audio data with a silent portion is shortened.

DETAILED DESCRIPTION OF THE EMBODIMENTS

Hereafter, the description will be oriented to an embodiment of the present invention with reference to the appended drawings.

Figure 1:
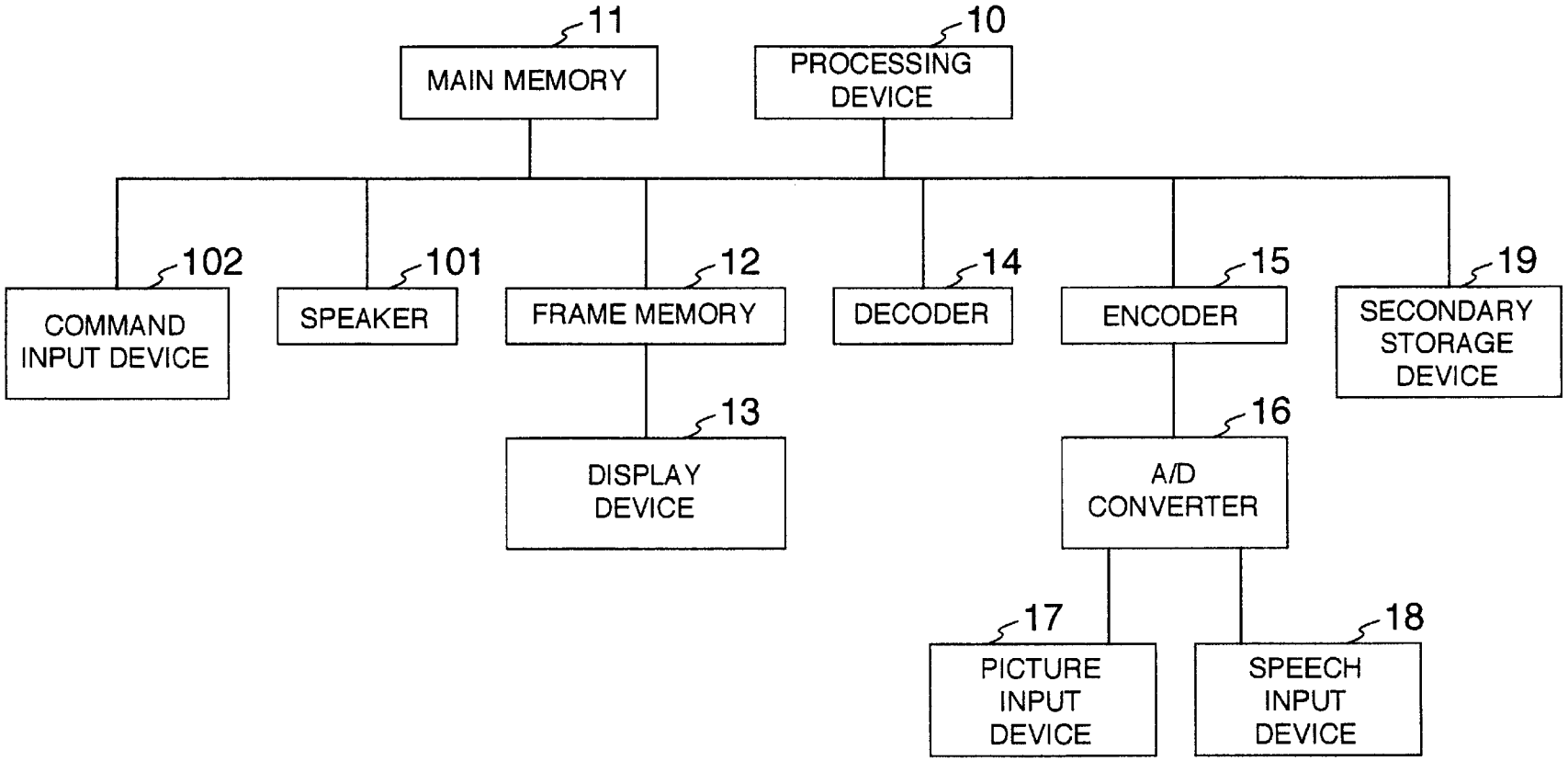
FIG. 1 is a block diagram showing a system configuration according to an embodiment of the present invention.

FIG. 1 is a block diagram showing a hardware arrangement according to an embodiment of the present invention.

As shown in FIG. 1, the hardware arrangement includes a processing device 10 for controlling each device of the arrangement, a main memory 11 to which a program for realizing this embodiment is to be loaded, a frame memory 12 for temporarily storing video data to be displayed, a display device 13 for displaying the video data, a decoder 14 for expanding the video data and the audio data, an encoder 15 for compressing the data, an A/D converter 16 for converting the audio data into digital audio data, a picture input device 17 for inputting the analog video data, a speech input device 18 for inputting the analog audio data, a secondary storage unit 19 for storing decoded data or program, and a speaker 101 served as a device for outputting speech.

An analog signal inputted from the picture input device 17 and the speech input device 18 is converted into a digital signal through the effect of the A/D converter 16. This conversion is executed respectively in the video data and the audio data. The encoder 15 operates to compress the digital signals and then output these signals as the MPEG format data. The MPEG data generated by the encoder 15 is stored in the secondary storage unit 19 or the main memory 11. The data stored in the main memory 11 or the secondary storage device 19 is expanded by the decoder 14 if a user needs to regenerate the data. The expanded video data is written in the frame memory 12 and then is displayed. The audio data expanded by the decoder 14 is regenerated through the speaker 101.

The program of this embodiment is started by an editing engine having a capability of doing many editing operations. These kinds of editing operations include a cutting operation for cutting from an input file or an input stream a piece of data to be used in another file, a pasting operation for doing the similar operation, a fading operation, a blending operation, a morphing operation, a tilting operation, a pasting operation of the audio data and the moving picture data, and so forth. In general, the editing engine operates to manage a lot of different editing works according to a kind of an operator provided by the application for requiring an editing operation. The editing engine, the application, and the program of this embodiment are stored in the secondary storage device 19. They are loaded into the main memory 11 by a starting command. The control device 10 is served as an editing device for executing each of those editing operations according to each command of the present program.

Figure 3:
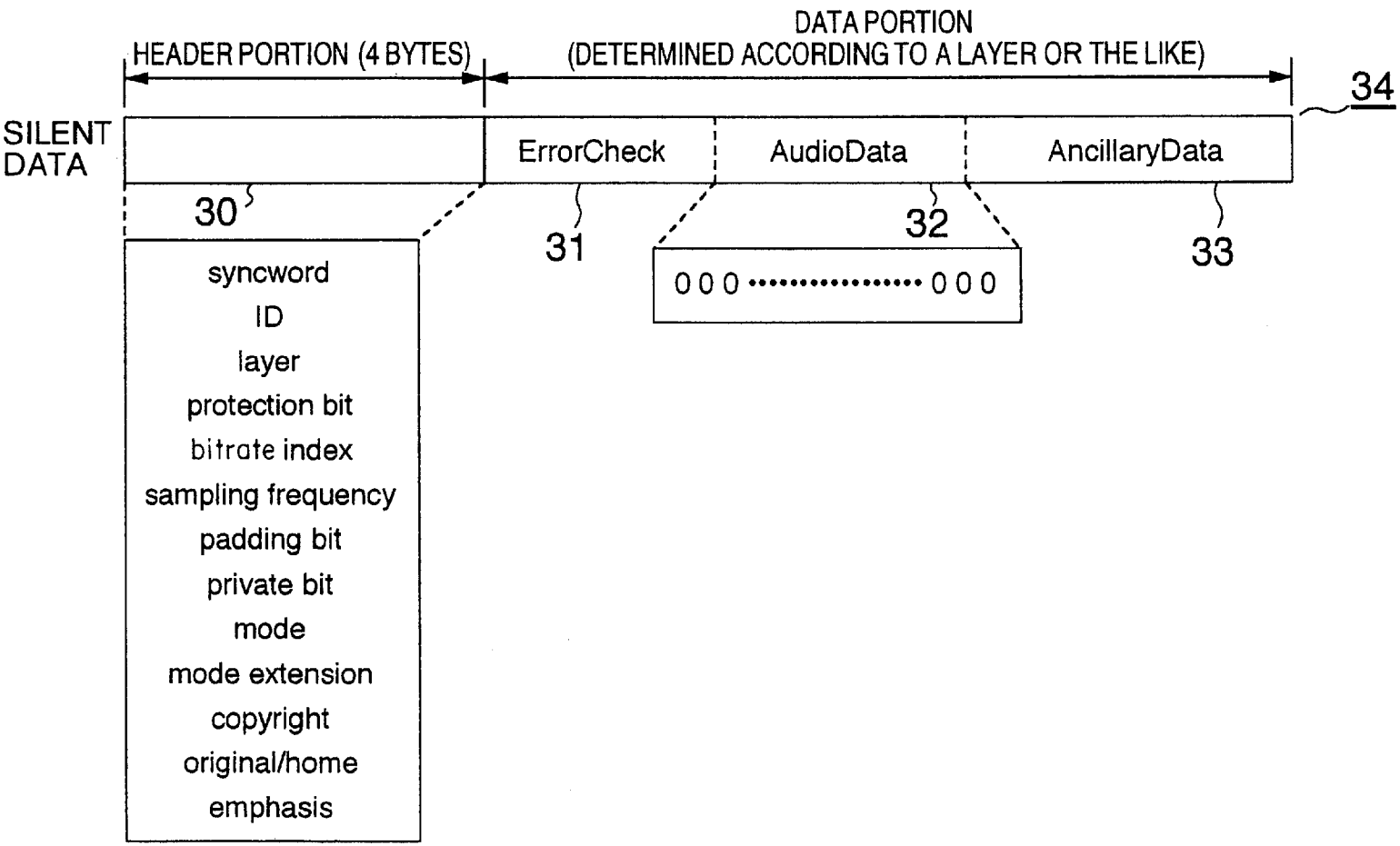
FIG. 3 is a view showing data composition of the dummy audio data used in the present invention.

FIG. 3 shows a data composition of the dummy audio data according to the present invention. The header portion 30 includes as its information syncword, ID, layer, protection bit, bitrate index, sampling frequency, padding bit, private bit, mode, mode extension, copyright, original/home, and emphasis (the details of which are described in ISO 11172-3). The size of the header portion 30 is four bytes.

The data portion 34 is composed of ErrorCheck 31, Audio Data 32, and Ancillary Data (external data) 33, the sizes of which are different according to the layer and the sampling frequency. The Audio Data 32 is variable length data. If the audio data does not reach the size of the AAU (Audio Access Unit), the remaining portion of the audio data is the Ancillary Data 33 to which any data except the MPEG audio data may be inserted. According to the invention, data of all "0"s, is stored in this Audio Data 32. If this sort of data is contained in the audio data, the MPEG decoder retrieves the syncword of the header that corresponds to the start of the next AAU without decoding the data. As stated above, the dummy audio data is composed of the AAU header and the data portion with all "0"s. This composition makes it possible to create the audio data that may be regenerated as silent data without having to compressing the data.

Figure 4:
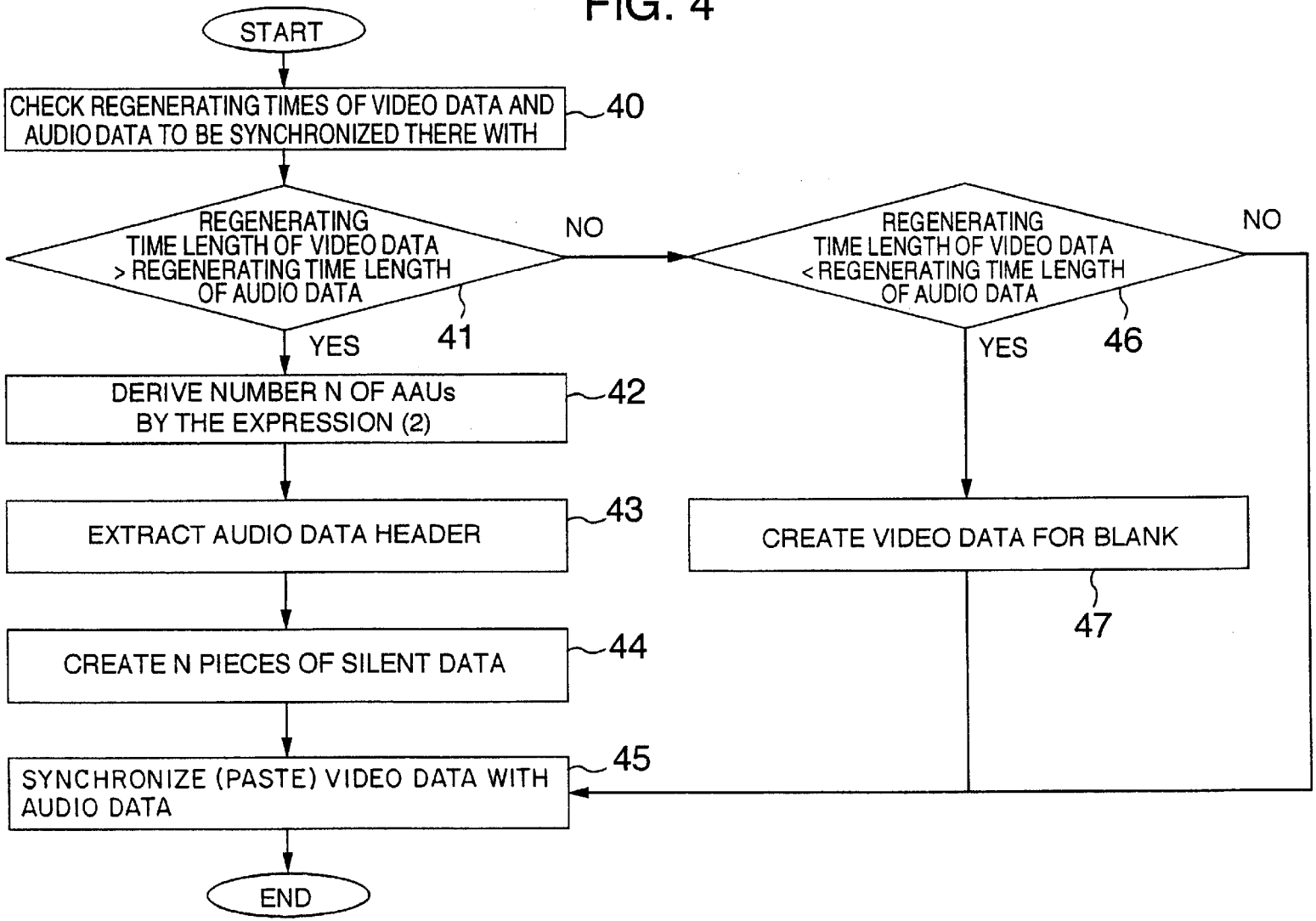
FIG. 4 is a flowahart showing a method of pasting the video data with the audio data.

Next, the description will be oriented to the summary of the processing steps executed in creating the dummy audio data shown in FIG. 3 when pasting the video data with the audio data from an input file with reference to FIG. 4. In general, the pasting operation is started when the application executes the pasting operation according to an indication given by the command input device 102.

At first, when the video data and the audio data to be synchronized therewith are specified by the command input device 102, the process 40 is executed to make access to the video data and the audio data specified by the editing device and to calculate the regenerating times of the video data and the audio data to be synchronized with each other.

The video data regenerating time length Lv can be calculated by the following expression (1).

$$Lv = \text{Number of pictures/picture rate} \quad (1)$$

Further, the audio data reproducing time length La can be calculated by the following expression (2)

$$La = \text{Number of } AAU\text{'s} \times X \quad (2)$$

wherein X is a reproducing time length per one AAU and may be derived by the following expression (3) according to the number of samples for each layer For the layer 1: $X$=384/Sampling Rate For the layer 2: $X$=1152/Sampling Rate (3)

Hence, the process 40 is executed to calculate a video data reproducing time length from the picture rate contained in the sequence header of the video data and the number of pictures in the editing range specified by the command input device 102. Further, the process 40 is executed to calculate an audio data reproducing time length from the layer information that is contained in the audio header, the sampling rate, and the number of AW's contained in the editing range. The number of pictures and the number of $AUU^1$s may be calculated by counting the picture headers and the audio sequence headers. Instead, they may be derived by PTS and TR. Next, the process 41 is executed to compare the video data reproducing time length with the audio data reproducing time length. If yes in the process 41, it indicates that the video data reproducing time length is longer than the audio data reproducing time length. Hence, it is necessary to create the dummy audio data. If yes in the process 46, it indicates that the audio data reproducing time length is longer than the video data reproducing time length. Hence, it is necessary to create the video data for a blank. If no in the process 46, it indicates that both time lengths are equal to each other. Hence, the video data may be pasted with the audio data in the process 45 without any treatment.

The process 42 is executed to derive the necessary number of AAUs N. Assuming that the difference of the reproducing time length between the video data and the audio data is Y, the number of AAUs N contained in the dummy audio data portion is derived by the following expression (4).

$$N=Y/X$$

wherein Y=Lv−La

If a fraction appears, it is rounded up when a value of N is derived.

Next, the process 43 is executed to read the header information of the dummy audio data from the header information of the audio data to be pasted therewith. Herein, the header information of the dummy audio data must be equal to that of the previous data. After this information is obtained, the process 44 is executed to create the dummy audio data shown in FIG. 3. Herein, the number of bytes S per AAU may be derived by the following expression (5)

For the layer 1:

$$S=\text{Audio Bit Rate/Sampling Rate}\times 12$$

For the layers 2 and 3:

$$S=\text{Audio Bit Rate/Sampling Rate}\times 144 \quad (5)$$

The size of the header information of one AAU is four bytes. The size of the error check is 16 bytes. The number B of bytes for storing 0 may be derived as follows:

If no error check is done: $B=S-4$

If an error check is done: $B=S-20$

By adding the corresponding number of 0 to the byte number B after the header portion, it is possible to create the dummy audio data of one AAU.

Lastly, the process 45 is executed to paste the video data with the audio data.

Figure 2:
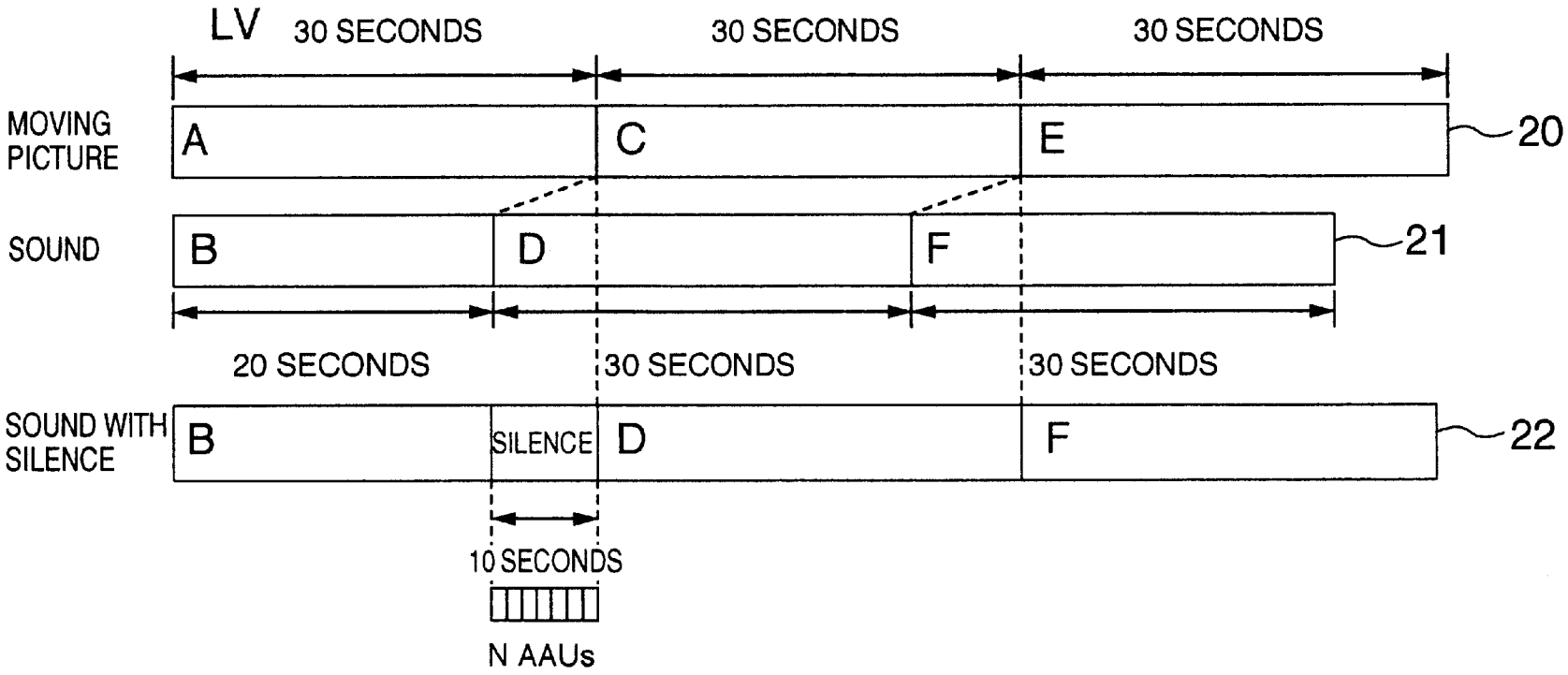
FIG. 2 is a view showing an example of data to be edited for describing the problem of the prior art.

As described above, by regenerating N pieces of dummy audio data and pasting those pieces of data with each other, it is possible to create the data with no lag between the audio data and the video data as shown in the data 22 of FIG. 2 for quite a short time.

The process indicated in the block 47 of FIG. 4 is disclosed in the U.S. patent application titled "A METHOD AND AN APPARATUS FOR CONTROLLING A BIT RATE OF PICTURE DATA, AND A STORAGE MEDIUM WHICH STORES A PROGRAM FOR CONTROLLING THE BIT RATE" Ser. No. 09/205,620 filed on Dec. 4, 1998 by the same applicant.

In turn, the description will be oriented to another embodiment of the invention. This embodiment concerns with the arrangement shown in FIG. 1, for example, and discloses the method of reading the analog video data from the picture input device 17 and the analog audio data from the speech input device 18 and creating the dummy audio data having the data composition shown in FIG. 3 when creating the moving picture speech compressed data.

Figure 5:
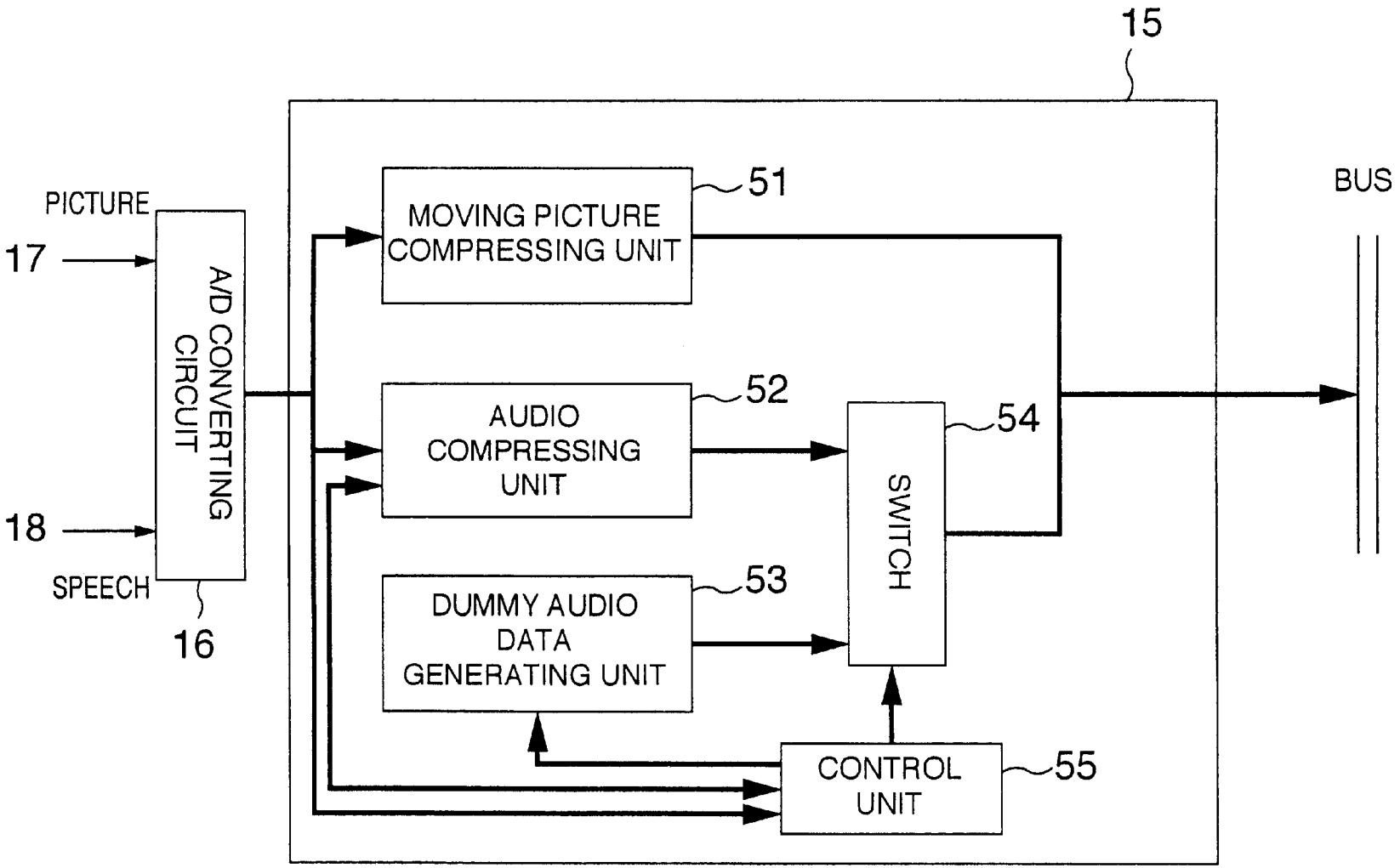
FIG. 5 is a block diagram schematically showing an encoder used for implementing an embodiment of the present invention.

FIG. 5 is a block diagram showing an encoder 15 according to this embodiment. The encoder included in this embodiment includes a moving picture compressing unit 51 for compressing the video data, an audio compressing unit 52 for compressing the audio data, a dummy audio data generating unit 53 for generating the dummy audio data according to the present invention, a switch 54, audio compressing unit 52 and a control unit 55 for controlling the dummy audio data generating unit 53 and the switch 54.

The video data and the audio data are converted into the digital data by the A/D converting circuit 16. The digital video and audio data are inputted into the encoder 15. The video data is compressed in the moving picture compressing unit 51. The audio data is inputted into the audio compressing unit 52 and the control unit 55. If the output of the speech data is less than a given value, the control unit 55 activates the dummy audio data generating unit 53 to generate the dummy audio data. The dummy audio data generating unit operates to generate a header portion of the normal compressed speech data and the dummy audio data composed of the data portion shown in FIG. 3. In this instance, the control unit 55 stops encode processing in the audio compressing unit 52. Furthermore, when the output of audio data exceeds a given value, then the control unit 55 instructs to re-start processing in the audio compressing unit 52. The control unit 55 operates to control the switch 54 to output the audio data compressed by the normal audio compressing unit 52 if the output of the audio data is higher than or equal to a given value or output the dummy audio data if it does not reach the given value. The compressed video data and the compressed audio data or the dummy audio data are synchronized with each other and then stored in a storage unit such as a secondary storage unit or a main memory.

As described above, if the output of the read audio data is equal to or lower than a certain value, the audio data is determined to be silent. The compressing process of the audio data is eliminated by creating the dummy audio data, thereby reducing the processing time of the overall compressing process.

According to this embodiment, when compressing the data read by the speech input device, the encoder is used which contains the control device for controlling the dummy audio data of the invention. The control unit is considered to be indicated by the processor included in the host.

Further, the present embodiment concerns with a local architecture. It goes without saying that the embodiment may concern with various type of architectures used for various cases that need the compression of the voiceless data, for example, the case that the moving picture data and the silent data are required to be compressed for transmitting only the picture through the effect of the mute function to another client connected to the network.

As set forth above, according to the embodiment of the invention, since the AAU header and the dummy header that conforms to the format of the audio data to be encoded are used when creating the silent data, it is possible to freely generate the MPEG audio data that results in being silent in decoding without any compressing process, thereby reducing the processing times taken in creating and editing the video and audio data whose regenerating time lengths are different from each other.

What is claimed is:

1. A method for editing compressed audio data comprising the steps of:

creating a header portion containing at least information for indicating a start of an audio unit to be decoded and having composite elements whose values are equal to those of the compressed audio data to which dummy data is to be added; and creating the audio data composed of the dummy data to be ignored at the decoding time.

2. The editing method as claimed in claim 1, further comprising the steps of:

calculating a regenerating time of the compressed audio data and a regenerating time of compressed video data;

deriving the number of minimum audio units from a difference of the regenerating times of said audio data and said video data; and wherein said step of creating the header portion is executed to create the header portion composed of header information extracted from said audio data, and said step of creating the dummy data is executed to create said dummy data corresponding to said number of minimum audio units.

3. The editing method as claimed in claim 2, wherein said audio unit is the minimum unit of the audio data corresponding to said original audio data to be decoded, and said dummy data corresponds to the difference of said regenerating time of the compressed audio data and said regenerating time of the compressed video data.

4. A method for editing compressed audio data comprising the steps of:

detecting an output of said compressed audio data; and creating a header portion containing at least information for indicating a start of an audio unit to be decoded if the output of said audio data does not contain a predetermined value, said header portion having composite elements whose values are equal to those of said compressed audio data and dummy audio data composed of dummy data to be ignored during a decoding time.

5. The editing method as claimed in claim 4, further comprising the steps of:

capturing video data through a picture input device;

compressing said video data;

indicating a start of creating said dummy audio data; and indicating an end of said dummy audio data.

6. The editing method as claimed in claim 4, wherein said audio unit is the minimum unit of said audio data corresponding to said inputted audio data to be decoded, and said dummy data is zero.

7. A system for editing audio data comprising:

a storage device for storing compressed audio data; and an editing device for obtaining header information by accessing said compressed audio data and creating a header having composite elements whose values are equal to those of said obtained header information and dummy audio data composed of dummy data to be ignored during a decoding time.

8. The editing system as claimed in claim 7, wherein said storage device stores compressed video data, and said editing device calculates the number of minimum audio unit corresponding to a difference of regenerating times between said compressed video data and said compressed audio data and creates the dummy audio data corresponding to the number of the minimum audio units for said difference of regenerating times.

9. A recording medium to be read by a computer, for storing a program comprising the steps of:

calculating regenerating times of compressed audio data and compressed video data;

creating the number of minimum audio units corresponding to a difference of said regenerating times between said audio data and said video data;

creating a header portion containing at least information for indicating a start of an audio unit to be decoded and having compose elements whose values are equal to those of said audio data; and creating dummy audio data having the number of minimum audio units corresponding to said difference of regenerating times to be ignored during a decoding time.

* * * * *